US005944430A

United States Patent [19]

Myung

[11] Patent Number: 5,944,430

[45] Date of Patent: Aug. 31, 1999

[54] AUTOMATIC SHEET FEEDER OF AN INK-JET PRINTER AND METHOD FOR FEEDING A SHEET OF PAPER

[75] Inventor: Ho-Suck Myung, Ahnyang, Rep. of Korea

[73] Assignee: SamSung Electronics Co., Ltd., Suwon, Rep. of Korea

[21] Appl. No.: 08/937,456

[22] Filed: Sep. 25, 1997

[30] Foreign Application Priority Data

Sep. 25, 1996 [KR] Rep. of Korea ..... 96-42644

[51] Int. Cl.[6] ..... B41J 13/10

[52] U.S. Cl. ..... 400/624; 271/153; 271/157; 271/167

[58] Field of Search ..... 271/145, 147, 271/152, 153, 154, 155, 157, 160, 167; 400/624, 625, 629, 703, 709

[56] References Cited

U.S. PATENT DOCUMENTS

| | | | |
|---|---|---|---|
| 4,212,456 | 7/1980 | Ruenzi | 271/4 |
| 4,319,742 | 3/1982 | Ulseth | 271/147 |
| 4,585,218 | 4/1986 | Williams et al. | 271/10 |
| 4,884,796 | 12/1989 | Daboub | 271/111 |
| 4,888,617 | 12/1989 | Okuzawa | 271/154 |
| 4,925,062 | 5/1990 | Tsukamoto et al. | 271/115 |
| 4,930,763 | 6/1990 | Horii et al. | 271/147 |
| 5,058,874 | 10/1991 | Miyoshi et al. | 271/4 |
| 5,100,122 | 3/1992 | Noda et al. | 271/155 |
| 5,104,111 | 4/1992 | Matsuda et al. | 271/153 |
| 5,228,676 | 7/1993 | Arai et al. | 271/157 |
| 5,240,239 | 8/1993 | Kim | 271/116 |
| 5,419,543 | 5/1995 | Nakamura et al. | 271/127 |
| 5,474,288 | 12/1995 | Lo et al. | 271/155 |
| 5,501,444 | 3/1996 | Yukimachi et al. | 271/127 |
| 5,711,519 | 1/1998 | Bortolotti | 271/145 Q |

*Primary Examiner*—Christopher A. Bennett
*Attorney, Agent, or Firm*—Robert E. Bushnell, Esq.

[57] ABSTRACT

An automatic sheet feeder for an ink-jet printer that uses a solenoid driven cam to move the paper tray away from the pickup roller when a sheet of paper is loaded into the printer from the automatic feed roller. This causes the paper transport velocity to be steadier and improves the quality of printing.

23 Claims, 6 Drawing Sheets

AUTOMATIC SHEET FEEDER OF AN INK-JET PRINTER AND METHOD FOR FEEDING A SHEET OF PAPER

CLAIM OF PRIORITY

This application makes reference to, incorporates the same herein, and claims all rights accruing thereto under 35 U.S.C. §119 through my patent application entitled Automatic Sheet Feeder of an Ink-Jet Printer and Method for Feeding a Sheet of Paper earlier filed in the Korean Industrial Property Office on the Sep. 25, 1996 and there duly assigned Serial No. 1996/42644.

BACKGROUND OF THE INVENTION

1. Field of the Invention

The present invention relates to ink-jet printers, and more particularly, to an automatic sheet feeding device and method for an ink-jet printer.

2. Background Art

A typical automatic sheet feeder for an inkjet printer uses a tray that supplies paper to an ink-jet printer. The tray often has an adjustment lever that allows the paper to be moved away from a pickup roller in order to load additional sheets of paper into the tray. After loading additional paper, the adjustment lever is moved in a direction opposite that used for preparing the tray to receive additional paper causing the pickup roller to press against the paper on the stand and then transfer the paper to a transfer roller. Then, the transfer roller transports the sheet of paper to the printer cartridge.

Other sheet feeding devices have also been developed, such as, U.S. Pat. No. 5,419,543 to Nakamura entitled Paper Feeding Apparatus for Printer, that shows a paper tray pushed by a bell crank towards a pickup roller at regular intervals to load paper. U.S. Pat. No. 4,585,218 to Williams entitled Mechanism for Feeding Similar Flat Items in Succession From a Stack Thereof, U.S. Pat. No. 5,501,444 to Yukimachi entitled Sheet Supply Apparatus, and U.S. Pat. No. 5,058,874 to Miyoshi entitled Automatic Document Conveying Device, each mention an automatic sheet feeder that has the pickup roller lifted away from the paper stack at regular intervals by a bell crank device. U.S. Pat. No. 4,212,456 to Ruenzi entitled Apparatus for Automatically Feeding Individual Sheets From a Stack Through an Office Machine, mentions an automatic sheet feeder used in conjuction with a page separator. U.S. Pat. No. 5,240,239 to Kim entitled Paper Sheet Feeding Apparatus, shows an automatic sheet feeder that sequentially loads sheets into a printer. Both U.S. Pat. No. 4,925,062 to Tsukamoto entitled Paper Feeder and U.S. Pat. No. 4,884,796 to Daboub entitled Singulator for Document Feeder, use solenoids in their gearing mechanisms in conjunction with their automatic sheet feeders.

I have observed that some printers do not end the contact between the pickup roller and the paper stack during the transfer of the sheet from the pickup roller to the transfer roller. This causes a frictional force to develop between the pickup roller and the sheet that is also contacting the transfer roller. This frictional force terminates once the sheet of paper has passed the pickup roller. The sudden cessation of frictional force causes a difference in the moving speed of the sheet before and after the sheet has passed the pickup roller that results in the degradation of the printing quality. I have also noticed that using an adjustment lever requires manual operations from the printer user, increases the number of the parts needed for assembly, and the cost of manufacturing the ink-jet printer. I expect that an automatic sheet feeder that moves the paper tray away from the pickup roller during the internal transferring of and printing on a sheet of paper, that stops the rotation of the pickup roller after conveying the sheet of paper to a transfer roller, that is of a simplified design, and that does not require the manual adjustment of a lever to load paper will increase the efficiency of operation and production of the automatic sheet feeder and its associated printer.

SUMMARY OF THE INVENTION

It is an object of the present invention to provide an ink jet printer with an automatic sheet feeder that makes constant the transport speed of a sheet of paper and improves the quality of printing.

It is another object to provide an ink-jet printer with an automatic sheet feeder that eliminates the need for an adjustment lever to load sheets of paper onto the tray.

It is still another object to provide an ink-jet printer with an automatic sheet feeder that separates the pickup roller from the sheet of paper during the transfer of the sheet by the transfer roller.

It is yet another object to provide an ink-jet printer with an automatic sheet feeder that stops the rotation of the pickup roller while a sheet of paper is being transfered by the transfer roller.

To achieve these and other objects, an ink-jet printer with an automatic sheet feeder uses a solenoid driven bell crank to push a paper stand away from a pickup roller during the transfer of a sheet inside the printer and during the printer operation. A sensor detects the edge of the sheet of paper as it passes by and reverses the rotation of a driving motor. This causes the solenoid to push a bell crank against the paper stack moving it away from the pickup roller. At the same time a pawl in the gearing mechanism becomes disengages which stops the rotation of the pickup roller until it is time to load another sheet of paper into the printer.

A method for feeding sheets of paper into the printer starts with a print command being sent that activates the solenoid and moves the bell crank away from the paper stand. This allows a spring to push the paper stand and associated paper into contact with the pickup roller. Then, a senso detects the edge of a sheet of paper as it passes by and sends a signal causing the driving motor to reverse direction. When this happens the pickup roller is disengaged from the driving motor and the solenoid pushes the paper stand away from the pickup roller. This gives enough time for the loaded sheet of paper to be transferred by the transfer roller to the printer cartridge and printed on by the printing head without interference from another sheet of paper.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 2A:
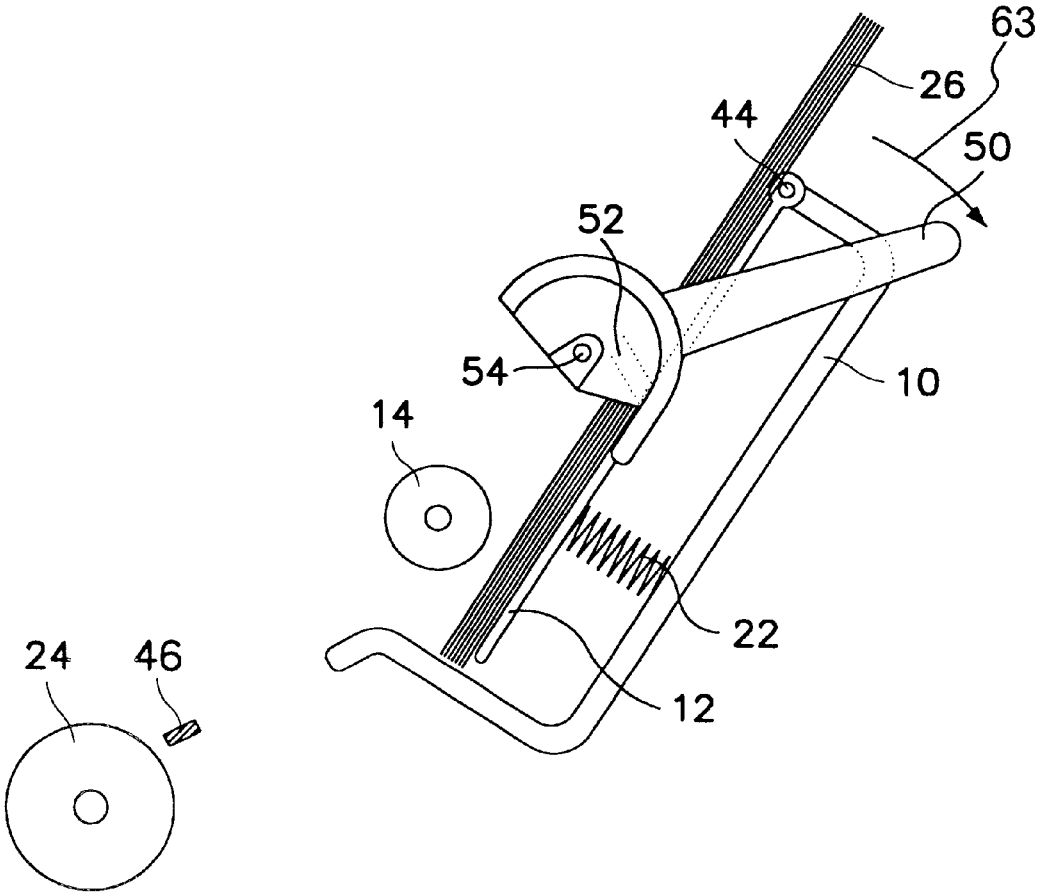
(Background Art) FIG. 2A
FIG. 2A is a schematic diagram of a typical ink-jet printer with an automatic sheet feeder loading sheets of paper.
Figure 2B:
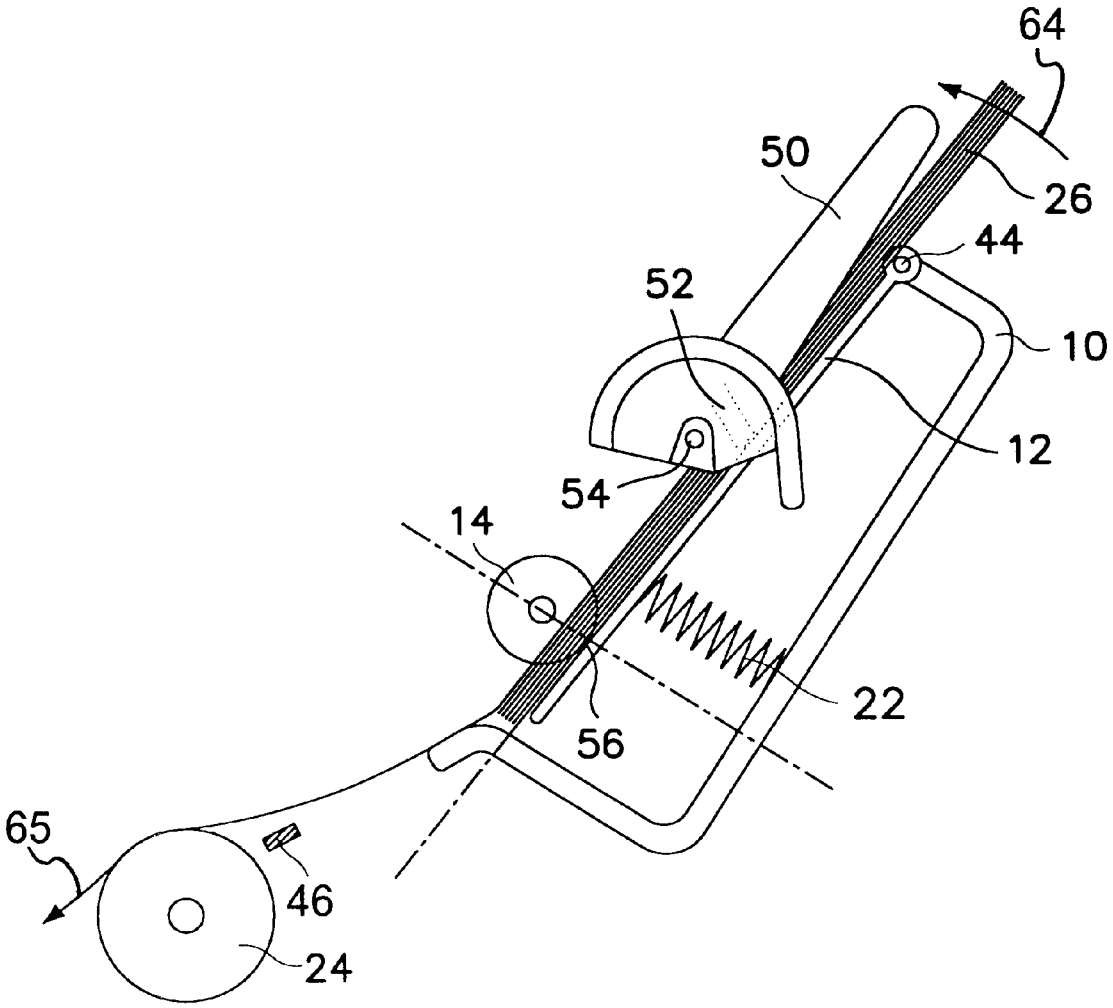
(Background Art) FIG. 2B
FIG. 2B is a view similar to FIG. 2A of a typical inkjet printer with an automatic sheet feeder transferring a sheet of paper.

Turning now to the drawings, particularly FIG. 2A, which illustrates a typical automatic sheet feeder for an ink jet printer that uses a tray 10 that supports a paper stand 12. The paper stand 12 supplies paper 26 to an ink-jet printer. The paper stand is pushed away from the base of the tray by a spring 22 that is mounted under the paper stand 12. The paper stand is connected to the tray 10 by a first fulcrum 44. An adjustment lever 50 is mounted on one side of the tray and pivots on a second fulcrum54. The adjustment lever allows the paper stand to be moved away from a pickup roller 14 while loading sheets of paper. On one side of the adjustment lever, near the second fulcrum 54, is a rib 52, that holds the paper stand fixedly in a position out of contact with the pickup roller.

A pickup roller 14 is positioned on one end of the paper stand and supplies paper to a transfer roller 24. The transfer roller is mounted on one side of the pickup roller and transfers paper to the ink jet printing head (not shown). Between the transfer roller 24 and the pickup roller 14 is a sensor 46 that detects the leading end of sheets of paper 26 in order to reverse the rotational direction of the drive motor 34 (shown in FIG. 1A).

At the beginning of the paper loading operation, the adjustment lever 50 must be pivoted around the second fulcrum 54 by pulling the lever towards the base of the tray 10, in the direction denoted 63. This moves a rib 52, located on the inner surface of the adjustment lever, into a position that contacts and depresses the paper stand 12. The paper stand pivots on the first fulcrum 44 and compresses the spring 22. The paper stand is held in place by the rib 52 on the adjustment lever while one loads paper onto the stand. Then one pushes the adjustment lever in a reverse direction 64 to return the paper stand 12 to its initial position. This causes the pickup roller 14 to press against the paper 26 on the stand because of the force provided by a spring.

The preferred embodiment of an automatic sheet feeder for an ink-jet printer is shown in FIGS. 1A, 1B, and 3A through 4. A tray 10 supports an inclined paper stand 12 upon which paper is placed. The paper stand 12 is pushed away from the base of the tray by a spring 22 that is mounted underneath. A first fulcrum 44 connects the paper stand to the tray. Inside the ink-jet printer is a solenoid that operates a bell crank that either brings the paper tray into or out of contact with the pickup roller. The solenoid 20 is turned on and off according to the rotational direction of the drive motor. The solenoid is initially turned off to separate the paper stand 12 and the pickup roller 14 in order to prepare for the loading of sheets of paper 26 onto the paper stand. The bell crank 16 is mounted around a second fulcrum 18 that causes the reciprocating motion of the solenoid 20 to be transformed into a pivoting motion that can move the paper stand 12.

A pickup roller 14 is located near the side of the paper stand 12 opposite from the first fulcrum. The pickup roller loads a cut sheet 26 into the printer and transports it to the transfer roller 24, that then transports the paper to the printer cartridge (not shown) to be printed on by the printing head. A sensor 46 is positioned between the transfer roller 24 and the pickup roller 14 to detect the leading end of the loaded sheet 26. When the leading edge is detected the rotational direction of the drive motor is reversed.

Figure 1A:
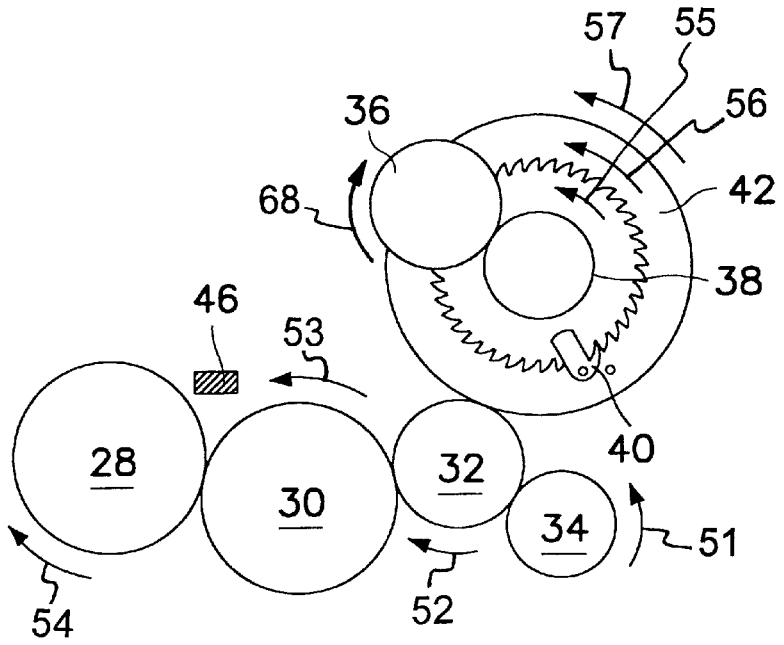
FIG. 1A is a schematic diagram of the operation of the gears associated with the automatic sheet feeder, constructed according to the preferred embodiment, in a printer during the process of loading a sheet of paper.
Figure 3A:
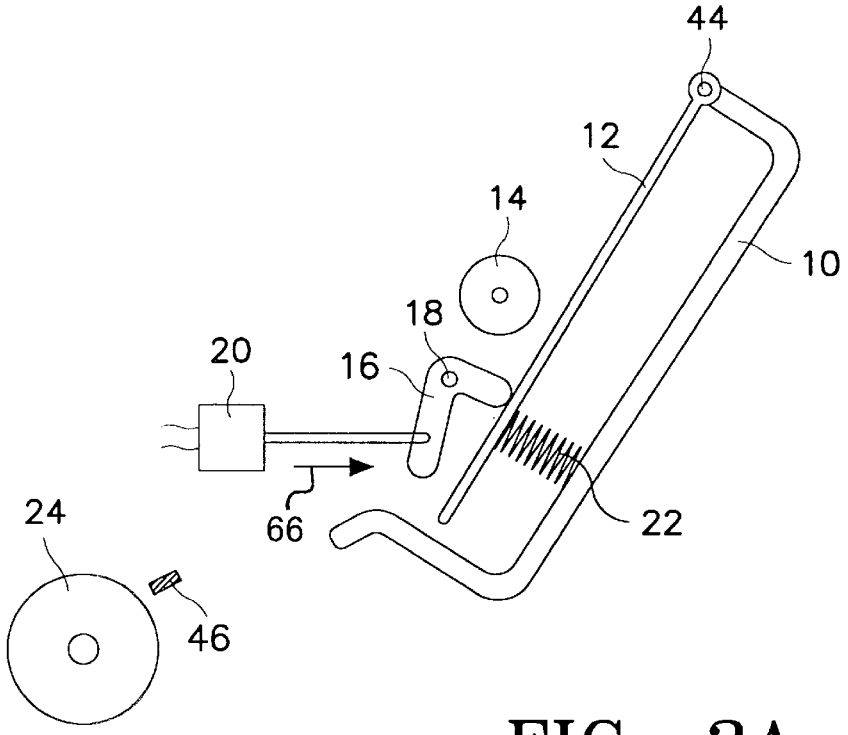
FIG. 3A is a schematic diagram of the preferred embodiment of an automatic sheet feeder before loading sheets of paper.
Figure 3B:
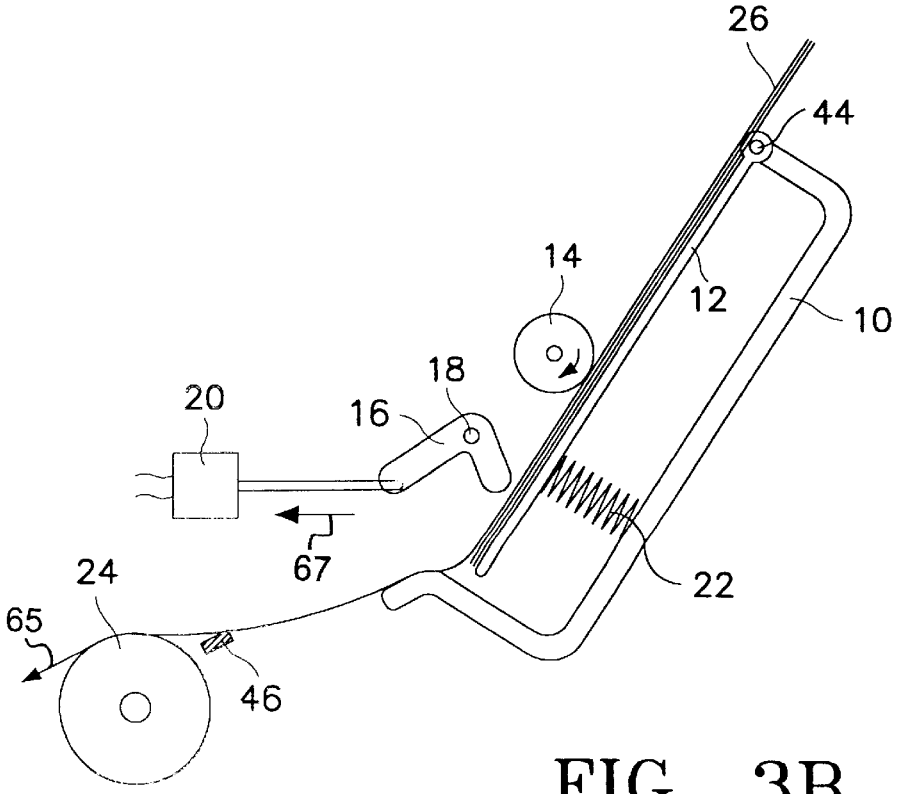
FIG. 3B is a view similar to FIG. 3A of a sheet of paper loaded in the preferred embodiment of the automatic sheet feeder.
Figure 3C:
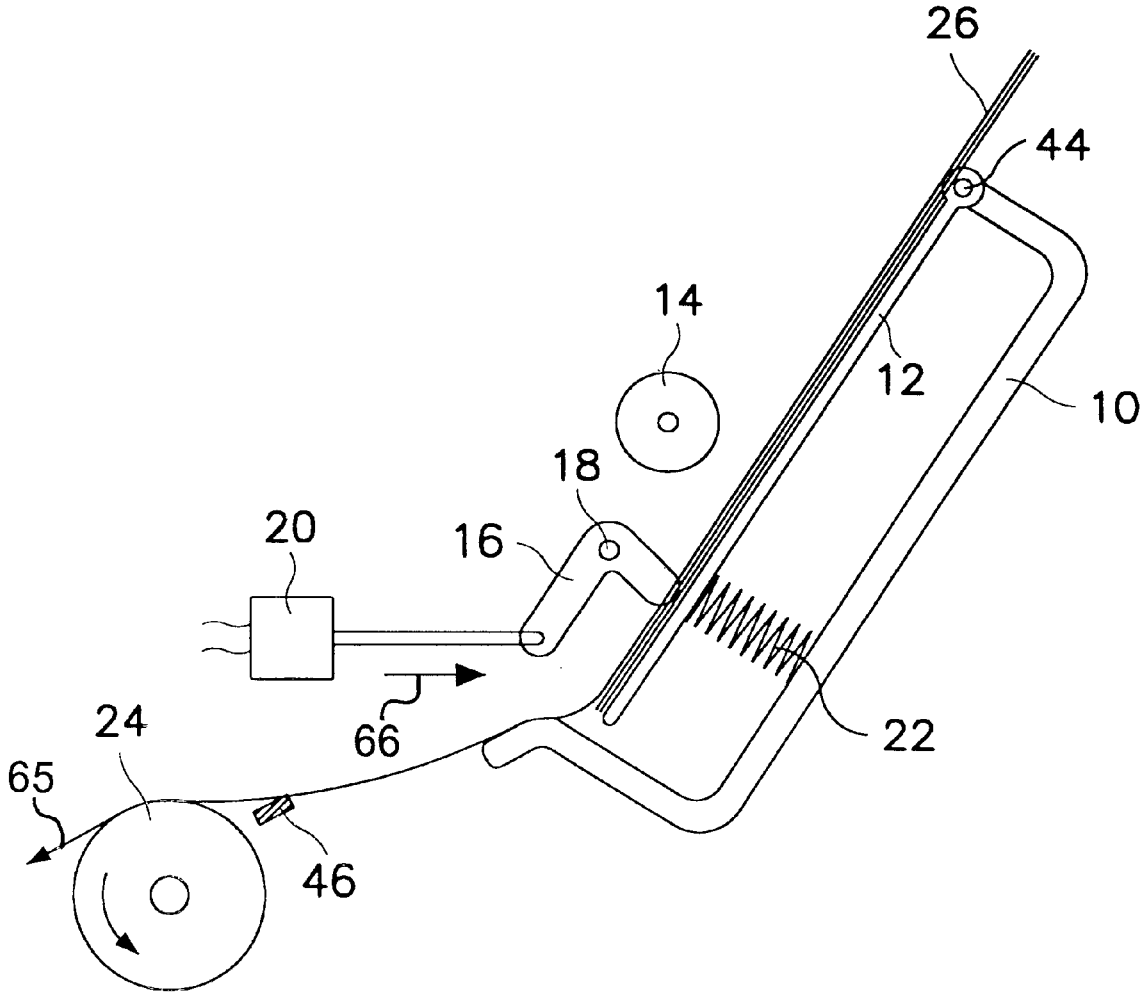
FIG. 3C is a view similar to FIG. 3B of the transferring of a sheet of paper by the preferred embodiment of an automatic sheet feeder.
Figure 4:
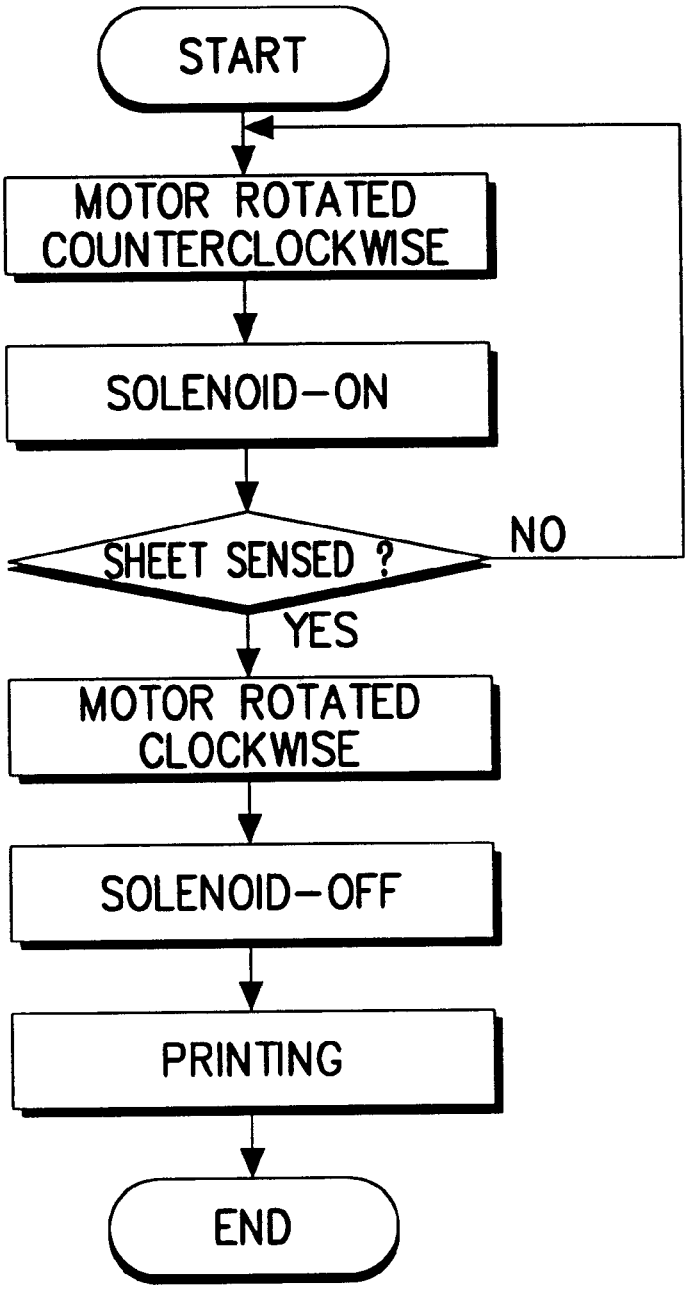
FIG. 4 is a flow chart of a process for feeding a sheet into the preferred embodiment of an automatic sheet feeder.

The operation of an automatic sheet feeder constructed according to the preferred embodiment is shown in FIGS. 3A to 4. First, the sheets are placed on the paper stand 12 that is mounted inside the tray 10, as shown in FIG. 3A. Then, the spring 22 is compressed because the paper stand 12 is moved towards the base of the tray. When the printer is turned on to begin the printing process the drive motor is driven in a counterclockwise direction 51, as shown in FIG. 1A. This causes the first idle gear 32 to rotate in a clockwise direction 52, that, in turn, rotates a second gear-ratchet 42 in a counterclockwise direction 57. Since the pawl 40 is engaged with the toothed wheel of the first gear-ratchet 38, the first gear-ratchet 38 is rotated in a counterclockwise direction 55. The ratchet gear then causes the pickup roller gear to rotate in a clockwise direction 68, thus the pickup roller 14 also rotates in a corresponding clockwise fashion.

Meanwhile, the solenoid 20 has retracted the bell crank 16, as shown in FIG. 3B. This causes the bell crank 16 to pivot on a second fulcrum 18 and allows the pickup roller 14 to contact the sheet 26 loaded on the paper stand 12 due to the force provided by the spring 22. This causes a sheet 26 to be fed to the printer by the pickup roller 14 and conveyed to the transfer roller 24.

Figure 1B:
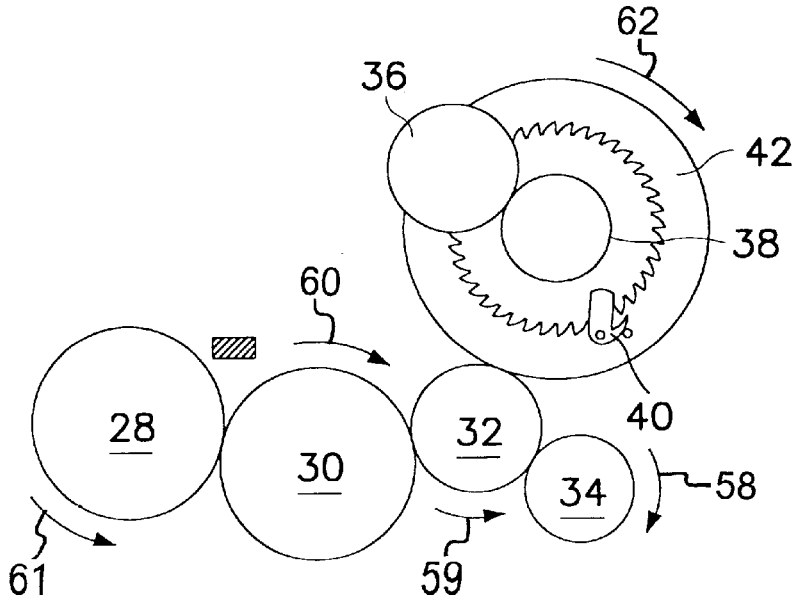
FIG. 1B is a view similar to FIG. 1A of the operation of the gears associated with an automatic sheet feeder, constructed according to the preferred embodiment, when the sheet is being transferred by the automatic feed roller.

Sensing the leading end of the sheet 26, a sensor 46 generates a control signal to rotate the drive motor 34 in a clockwise direction 58, as shown in FIGS. 1B and 3C, so that the pawl 40 is disengaged from the first ratchet gear 38. This terminates the driving connection between the drive motor 34 and the first ratchet gear 38. While the drive motor 34 rotates in a clockwise direction 58, the first idle gear is forced to rotate in a counterclockwise direction 59. This, in turn, causes the second idle gear 32 to rotate in a clockwise direction 60, thus causing the transfer roller gear 28 to rotate in a counterclockwise direction 61. This stops the motion of the pickup roller gear 36 and, consequently, stops the motion of the pickup roller also.

At the same time, the solenoid 20 is deactivated and pushes the bell crank towards the paper stand 12, as shown in FIG. 3C. This causes the bell crank 16 to pivot on a second fulcrum 18 and to push the paper stand 12 away from the pickup roller. This allows the already loaded sheet of paper 26 to be transferred by the transfer roller 24 to the printer cartridge without interference by other sheets being loaded by the pickup roller 14.

As described above, the inventive automatic sheet feeder eliminates the conventional manual adjustment lever, so that it eliminates not only the manual operation, but also decreases the number of the parts and thus the cost. Moreover, when the transfer roller transfers the sheet to the carriage, the pickup roller is separated from the sheet to keep the moving speed of the sheet, thereby resulting in improvement of the printing quality.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. An automatic sheet feeder for use with a printer, comprising:

a pickup roller feeding cut sheets of paper into said printer and conveying a sheet to a transfer roller;

paper supporting means contained in a tray and supporting a plurality of sheets of paper;

a motor providing a driving rotational force in both a normal and a reverse direction and serving as a driving source for said pickup roller;

drive control means to select either said normal or said reverse direction for said driving rotational force;

driving mechanism means comprising a plurality of gears for transferring said driving rotational force generated by said motor;

a spring positioned between said tray and said paper supporting means and applying a separating force to both said tray and said paper supporting means;

a bell crank pivotally positioned on an opposite side of said paper supporting means from said tray, said bell crank pivotally attached to a fulcrum and capable of pushing said paper supporting means towards said tray and causing said plurality of paper and said pickup roller to separate; and bell crank driving means for rotating said bell crank, separating said plurality of paper from said pickup roller, and allowing said plurality of paper to come into contact with said pickup roller resulting in the loading of an individual sheet of paper into said printer.

2. The automatic sheet feeder for use with a printer of claim 1, further comprised of said paper supporting means being hingedly connected to said tray at an end opposite that of said pickup roller.

3. The automatic sheet feeder for use with a printer of claim 1, further comprised of said paper supporting means being hingedly connected to said tray at an end opposite that of said pickup roller.

4. The automatic sheet feeder for use with a printer of claim 1, further comprised of said bell crank being L-shaped.

5. The automatic sheet feeder for use with a printer of claim 1, further comprised of said bell crank driving means being a solenoid activated and deactivated by a controller during printing operations.

6. The automatic sheet feeder for use with a printer of claim 1, further comprised of said drive control means being a paper edge sensor detecting the edge of said sheet and changing a direction of said driving rotational force from said motor to allow said sheet to be printed on without interference from another sheet.

7. The automatic sheet feeder for use with a printer of claim 1, further comprised of said driving mechanism means comprising:

a first idle gear receiving said driving rotational force from said motor;

a supplemental gear in contact with said first idle gear and having a protrusion near an outer edge, said supplemental gear being supported on a common axis with a ratchet gear having a pawl, said ratchet gear having said pawl engaged and being driven by said supplemental gear when said supplemental gear is driven in one direction, said ratchet gear being separated from any driving force when said supplemental gear is driven in an opposite direction;

a pickup roll gear driven by said ratchet gear when said pawl is engaged; and a second idle gear driven by said first idle gear and driving a transfer roll gear.

8. An automatic sheet feeder for use with a printer of claim 1, further comprised of said solenoid being activated and deactivated according to the rotational direction of said motor.

9. An automatic sheet feeder for use with a printer, comprising:

a pickup roller feeding cut sheets of paper into said printer and conveying a sheet to a transfer roller;

paper supporting means contained in a tray and supporting a plurality of sheets of paper;

a motor providing a driving rotational force in both a normal and a reverse direction and serving as a driving source for said pickup roller;

drive control means to select either said normal or said reverse direction for said driving rotational force;

driving mechanism means comprising a plurality of gears for transferring said driving rotational force generated by said motor;

a spring positioned between said tray and said paper supporting means and applying a separating force to both said tray and said paper supporting means;

a bell crank pivotally positioned on an opposite side of said paper supporting means from said tray, said bell crank pivotally attached to a fulcrum and capable of pushing said paper supporting means towards said tray and causing said plurality of paper and said pickup roller to separate; and a solenoid driving said bell crank and causing said bell crank to rotate, separating said plurality of paper from said pickup roller, and allowing said plurality of paper to come into contact with said pickup roller resulting in the loading of an individual sheet of paper into said printer.

10. The automatic sheet feeder for use with a printer of claim 9, further comprised of said paper supporting means being hingedly connected to said tray at an end opposite that of said pickup roller.

11. The automatic sheet feeder for use with a printer of claim 9, further comprised of said paper supporting means being hingedly connected to said tray at an end opposite that of said pickup roller.

12. The automatic sheet feeder for use with a printer of claim 9, further comprised of said bell crank being L-shaped.

13. The automatic sheet feeder for use with a printer of claim 9, further comprised of said drive control means being a paper edge sensor detecting the edge of said sheet and changing a direction of said driving rotational force from said motor to allow said sheet to be printed on without interference from another sheet.

14. The automatic sheet feeder for use with a printer of claim 9, further comprised of said driving mechanism means comprising:

a first idle gear receiving said driving rotational force from said motor;

a supplemental gear in contact with said first idle gear and having a protrusion near an outer edge, said supplemental gear being supported on a common axis with a ratchet gear having a pawl, said ratchet gear having said pawl engaged and being driven by said supplemental gear when said supplemental gear is driven in one direction, said ratchet gear being separated from any driving force when said supplemental gear is driven in an opposite direction;

a pickup roll gear driven by said ratchet gear when said pawl is engaged; and a second idle gear driven by said first idle gear and driving a transfer roll gear.

15. An automatic sheet feeder for use with a printer of claim 9, further comprised of said solenoid being activated and deactivated according to the rotational direction of said motor.

16. An automatic sheet feeder for use with a printer, comprising:

a pickup roller feeding cut sheets of paper into said printer and conveying a sheet to a transfer roller;

paper supporting means contained in a tray and supporting a plurality of sheets of paper;

a motor providing a driving rotational force in both a normal and a reverse direction and serving as a driving source for said pickup roller;

drive control means comprised by a paper edge sensor changing either said normal or said reverse direction for said driving rotational force upon the detection of an edge of said sheet;

driving mechanism means comprising a first idle gear receiving said driving rotational force from said motor;

a supplemental gear in contact with said first idle gear and having a protrusion near an outer edge, said supplemental gear being supported on a common axis with a ratchet gear having a pawl, said ratchet gear having said pawl engaged and being driven by said supplemental gear when said supplemental gear is driven in one direction, said ratchet gear being separated from any driving force when said supplemental gear is driven in an opposite direction;

a pickup roll gear driven by said ratchet gear when said pawl is engaged; and a second idle gear driven by said first idle gear and driving a transfer roll gear;

a spring positioned between said tray and said paper supporting means and applying a separating force to both said tray and said paper supporting means;

a bell crank pivotally positioned on an opposite side of said paper supporting means from said tray, said bell crank pivotally attached to a fulcrum and capable of pushing said paper supporting means towards said tray and causing said plurality of paper and said pickup roller to separate; and a solenoid driving said bell crank and causing said bell crank to rotate, separating said plurality of paper from said pickup roller, and allowing said plurality of paper to come into contact with said pickup roller resulting in the loading of an individual sheet of paper into said printer.

17. The automatic sheet feeder for use with a printer of claim 16, further comprised of said paper supporting means being hingedly connected to said tray at an end opposite that of said pickup roller.

18. The automatic sheet feeder for use with a printer of claim 16, further comprised of said paper supporting means being hingedly connected to said tray at an end opposite that of said pickup roller.

19. The automatic sheet feeder for use with a printer of claim 16, further comprised of said bell crank being L-shaped.

20. An automatic sheet feeder for use with a printer of claim 16, further comprised of said solenoid being activated and deactivated according to the rotational direction of said motor.

21. A process for an automatic sheet feeder used with a printer, comprising the steps of:

receiving a print command and activating a motor;

activating a solenoid driving a bell crank into a position allowing a paper stand bearing a plurality of paper to contact a pickup roller;

sensing an edge of a sheet as it passes between said pickup roller and a transfer roller and reversing a direction of a driving force provided by said motor causing said pickup roller to stop rotating;

deactivating a solenoid and causing said plurality of paper to move away from said pickup roller; and printing on said sheet.

22. A process for an automatic sheet feeder used with a printer of claim 21, further comprised of said pickup roller being in contact with said paper stand by means of a force from a spring.

23. A process for an automatic sheet feeder used with a printer of claim 21, further comprised of said solenoid being initially turned off to separate said paper stand and said pickup roller to prepare for the loading cut sheets of paper onto said paper stand.

* * * * *